US007229483B2

(12) United States Patent
Lewis

(10) Patent No.: US 7,229,483 B2
(45) Date of Patent: Jun. 12, 2007

(54) GENERATION OF AN ULTRA-SUPERHEATED STEAM COMPOSITION AND GASIFICATION THEREWITH

(76) Inventor: Frederick Michael Lewis, 535 E. Mariposa Ave., El Segundo, CA (US) 90245

( * ) Notice: Subject to any disclaimer, the term of this patent is extended or adjusted under 35 U.S.C. 154(b) by 652 days.

(21) Appl. No.: 10/113,619

(22) Filed: Apr. 1, 2002

(65) Prior Publication Data

US 2003/0233788 A1 Dec. 25, 2003

Related U.S. Application Data

(63) Continuation-in-part of application No. 09/803,782, filed on Mar. 12, 2001.

(51) Int. Cl.
*C01B 3/36* (2006.01)

(52) U.S. Cl. ..... 48/197 R; 48/61; 48/62; 48/202; 48/196; 48/206; 431/2; 431/9; 431/10; 431/181; 431/182; 431/183; 431/184; 431/185; 431/186; 431/187; 431/188

(58) Field of Classification Search ..... 48/61, 48/62, 197 R, 202, 196, 206; 431/2, 9, 10, 431/181–188
See application file for complete search history.

(56) References Cited

U.S. PATENT DOCUMENTS

| | | | | |
|---|---|---|---|---|
| 2,631,921 A | | 3/1953 | Odell | 23/1 |
| 2,671,723 A | | 3/1954 | Jahniq et al. | 48/206 |
| 2,672,410 A | | 3/1954 | Mattox | 48/206 |
| 2,681,273 A | | 6/1954 | Odell | 48/196 |
| 3,959,401 A | | 5/1976 | Albright et al. | 260/693 R |
| 4,004,896 A | | 1/1977 | Soo | 48/202 |
| 4,013,428 A | | 3/1977 | Babbitt | 48/202 |
| 4,060,379 A | * | 11/1977 | LaHaye et al. | 432/179 |
| 4,380,429 A | * | 4/1983 | LaHaye et al. | 431/115 |
| 4,412,808 A | * | 11/1983 | Sheppard et al. | 431/8 |
| 5,052,921 A | * | 10/1991 | Hemsath | 432/121 |
| H1325 H | | 7/1994 | Doering et al. | 48/179 |
| 6,048,508 A | | 4/2000 | Dummersdorf et al. | 423/210 |

FOREIGN PATENT DOCUMENTS

WO WO 9851966 A1 * 11/1998

OTHER PUBLICATIONS

Hedley et al., The Use of Adiabatic Steam Gasification for the Production of Chemical Synthesis From Coal, 1986, (Univ. Sheffield, England).

Univ of Sheffield Dept. of Chemical and Process Eng, Combustion and Incineration Group, Some of the Group's Recent Research Projects, Sep. 22, 2001 (http://www.shef.ac.uk/~cig/cigresearch.htm).

F.M. Lewis, et al., High Temperature, Steam-Only Gasification and Steam Reforming With Ultra-Superheated Steam, 5th Intl. Symposium On High Temp. Air Combustion and Gasification, Yokohama, Japan, Oct. 30, 2002.

F.M. Lewis et al., Hydrogen From Coal Utilizing Allothermal Ultra-Superheated Steam Reforming, Overhead projection figures accompan-Ying an oral presentation of the use of Ultra-Superheated Steam Composition in allothermal reforming of an Ohio coal, Columbus, Ohio, Jun. 2004.

* cited by examiner

*Primary Examiner*—Glenn Caldarola
*Assistant Examiner*—Vinit H Patel
(74) *Attorney, Agent, or Firm*—Allen H. Erickson

(57) ABSTRACT

A method for gasifying carbonaceous materials to fuel gases comprises the formation of an ultra-superheated steam (USS) composition substantially containing water vapor, carbon dioxide and highly reactive free radicals thereof, at a temperature of about 2400° F. (1316° C.) to about 5000° F. (2760° C.). The USS composition comprising a high temperature clear, colorless flame is contacted with a carbonaceous material for rapid gasification/reforming thereof. The need for significant superstoichiometric steam addition for temperature control. Methods for controlling a gasification/reforming system to enhance efficiency are described. A USS burner for a fluidized bed gasification/reforming reactor, and methods of construction, are described.

17 Claims, 8 Drawing Sheets

GENERATION OF AN ULTRA-SUPERHEATED STEAM COMPOSITION AND GASIFICATION THEREWITH

This application is a continuation-in-part of application Ser. No. 09/803,782 filed Mar. 12, 2001.

BACKGROUND OF THE INVENTION

1. Field of the Invention

The present invention relates generally to gasification of carbonaceous materials to useful fuel gases and other products. More particularly, the invention pertains to methods and apparatus for generating a highly reactive gasifying agent and uses thereof in thermal gasification processes.

2. State of the Art

Thermal gasification using superheated steam is a well-known art. In a typical thermal gasification process, a carbonaceous material such as coal, cellulosic waste, or other carbon-containing material is reacted with steam or a hot gas at temperatures greater than about 1400° F. (760° C.), to produce a combustible fuel gas largely composed of carbon monoxide (CO) and hydrogen (H2). Also, carbon dioxide (CO2) and water vapor (H2O) are generally present in substantial quantities. Methanation, which increases exponentially with pressure and decreases with increasing reactor temperature, also occurs to produce hydrocarbons e.g. methane. Small amounts of other gases such as ethane and ethylene may also be produced. The gasification conditions are controlled to yield a product gas for use as a fuel or as a feedstock for making other hydrocarbon fuels, ammonia, methanol, hydrazine, and other chemical species.

The well-known chemical reactions which occur in thermal gasification of carbonaceous materials include the following endothermic equations:

$$C+H2O \rightleftharpoons H2+CO-56{,}520 \text{ BTU/lb-mol carbon} \quad (1)$$

$$C+2H2O \rightleftharpoons 2H2+CO2-38{,}830 \text{ BTU/lb-mol carbon} \quad (2)$$

The actual composition of the product gas is influenced by many factors, including the quantities and composition of incoming feed materials, gasification temperature, pressure, and reactor residence time.

Thus, starting with a set of chemical component input and gasification conditions, the actual composition of the product gas is calculated by consideration of reaction rates, chemical equilibria, mass balances, and thermal balances. In some systems, catalysts are utilized to change the reaction rates and shift the composition of the product gas, i.e. syngas.

A major concern in developing workable processes for gasifying materials such as coal and biosolids is the high thermal energy requirement for driving the endothermic reactions.

In most gasification processes, substantial heat must be provided to satisfy the highly endothermic chemical reactions. This heat is typically provided by either (a) partially combusting the incoming carbonaceous material, (b) exothermically reacting a material such as calcined lime with carbon dioxide, and/or (c) by providing heat from an outside source, e.g. hot char circulation, addition of excess steam, etc.

In some gasification systems, mixtures of air and steam are used as the gasifying agent, and some or all of the required heat is provided by oxidation of a portion of the carbonaceous feed material within the gasification reactor.

In such systems, heating of the inert nitrogen gas in the air wastes energy, and the produced gas will contain a substantial fraction of free nitrogen, resulting in a low heating value.

Gasification with a mixture of steam and pure or enhanced oxygen gas has been promoted, but full development has been hindered because (a) a large portion of the carbonaceous material is combusted to non-fuels ($CO_2$ and water), and (b) the resulting product gas contains a low ratio of hydrogen gas to the total of carbon dioxide and carbon monoxide. The primary industrial need is for gases with higher $H_2$:CO ratios, because hydrogen is used for hydrogenation, a common chemical engineering practice, and shows great potential for use in fuel cells. Hydrogen has a high value in the chemical industries, and its oxidation byproduct is water, a non-pollutant.

Steam-only gasification has been investigated and used commercially since about 1950-1960. It is usually desirable to maintain a steam:carbon ratio which is close to a value at which the carbon is fully reacted by reactions (1) and (2) above, with minimal excess steam. More particularly, the conversion of carbon to CO should be maximized, as in reaction (1). Thus, an extraneous heat source is usually provided to supply the necessary heating requirements. The product gas typically has a higher $H_2$:CO ratio than when gasifying with a mixture of steam and air or oxygen. However, because of the limited heat in the steam, the problems associated with steam-only gasification include low achievable reaction temperatures i.e. typically less than about 1500° F. (815° C.), where long residence times and high energy consumption prevail. To operate at higher temperatures, complex heat transfer systems are utilized in order to avoid intermingling of combustion gases with the gasification products. Such systems entail high capital and operating costs, and are generally considered to be uneconomic.

In U.S. Pat. No. 4,004,896 of Soo, it is proposed to operate a thermal gasification system with a large quantity of excess steam, i.e. 2-10 times that required for full gasification of the carbon. In Soo, the thermal requirements of gasification are provided by copious quantities of steam. However, the quantities of $H_2$ and CO produced per pound of steam are low.

The use of high temperature superheated steam for gasification processes has been proposed. In a system configuration described in Emerging Technology Bulletin No. EPA/540/F-93/XXX entitled SPOUTED BED REACTOR, dated August 1993, by the U.S. Environmental Protection Agency, streams of methane and pure oxygen are fed to a burner, with the hot flame injected into a stream of low temperature steam which is passed into a primary gasification reactor. The gasification temperature is partially maintained by oxidation of portions of the feed material and gases leaving the reactor. The injected steam supplies only a portion of the heat required to maintain the low gasification temperature.

U.S. Pat. No. 3,959,401 of Albright et al. describes an apparatus for cracking gaseous and liquid hydrocarbon feedstocks to other chemicals, using a hot gas. It is stated that a hot gas temperature up to 3000° C. (5432° F.) may be used. The source of the hot gas and its composition is not indicated. Furthermore, the sole purpose of the hot gas is to supply heat for the endothermic cracking reactions. The hot gas does not react to become part of the product. The purpose of the apparatus is cracking, and gasification of carbonaceous materials to CO and $H_2$ is not in view.

In U.S. Pat. No. 4,013,428 of Babbitt, an oxygen blown system for gasifying powdered coal is described. A fuel is pre-burned with oxygen to form a mixture of steam and $CO_2$ to which a small amount of water is added. The combustion temperature is indicated to be about 4722° F., and the gas is contacted with the powdered coal to produce a product gas. Each of fuel, oxygen and steam is separately introduced into the pre-burner.

Babbitt also describes a process in which the pre-burner is fed separate streams of fuel, air and steam, creating a gasifying agent containing $CO_2$, steam and inert nitrogen at a temperature of about 3770° F. The presence of nitrogen is detrimental to energy efficiency and results in a product gas of lower heating value.

In U.S. Pat. No. 2,672,410 to Mattox and U.S. Pat. No. 2,671,723 to Jahnig et al., a mixture of oxygen and steam is introduced into a gasifier vessel. The mixture is passed through a porous distribution plate into a bed of gasifier feed material, a portion of which is combusted by the oxygen to generate heat for endothermic gasification.

In U.S. Pat. Nos. 2,631,921 and 2,681,273 to Odell, a mixture of steam and oxygen is passed through a porous distribution plate into a stationary bed of gasifier feed material, or a bed or catalyst or packing solids with high surface area. The batch process is started by initially combusting a fuel below the bed to ignite the bed, then blasting with air until the bed reaches and maintains gasification temperatures.

In U.S. Statutory Invention Registration (SIR) number H1325 to Doering et al., a coal gasification process is described in which oxygen and steam are added to a stream of coal and recycled flyash. The mixture is introduced into a gasifier reactor, where partial combustion occurs.

U.S. Pat. No. 6,048,508 to Dummersdorf et al. discloses a gasification process in which a portion of the synthesis gas from a secondary reformer is cooled and passed through a multistage gas separation plant to separate CO from the other components. The CO is used for other processes, while the remaining other components are returned to the gas stream downstream from where the gas was drawn off, to be treated in a CO conversion stage with the rest of the raw synthesis gas.

BRIEF SUMMARY OF THE INVENTION

A primary object of the present invention is to provide a gasification process for gasifying a carbonaceous material such that a maximum quantity of usable product gas, i.e. syngas, is obtained per unit of steam introduced into the gasifier reactor.

Another object of the invention is to provide a thermal gasification process in which a maximum quantity of usable syngas is obtained per unit of oxygen burned in a pre-burner, in order to operate at lower cost.

Another object of the invention is to provide a gasification process in which the gasification rate at temperatures of about 1200° F. (649° C.) to about 2800° F. (1538° C.) is significantly increased.

An additional object of the present invention is to provide a gasification process in which the gasifying agent is a high energy ultra-superheated steam composition substantially free of oxygen and nitrogen, and contains a high concentration of dissociation free radicals.

A further object of the invention is to provide a gasification process wherein all or nearly all of the heat requirement is supplied by a gasifying agent comprising a high energy ultra-superheated steam composition of low concentrations of oxygen and nitrogen.

Another object of the invention is to provide a method whereby a maximum of hydrogen gas is produced per unit of oxygen consumed.

An additional object of the invention is to provide methods for controlling a gasification system at conditions optimal with respect to raw material consumption, yield, and cost.

Other objects and considerations of the invention will become apparent in the description of the invention when taken in conjunction with the attached drawings.

In accordance with the invention, it has been discovered that a highly reactive composition of steam may be formed under certain conditions. This composition is denoted herein as ultra-superheated steam, abbreviated herein as USS, and is indicated as providing significant advantages as a gasifying agent in thermal gasification (including steam reforming processes) of carbonaceous materials including hydrocarbons, carbohydrates, and carbon compounds containing free or chemically combined halogens, sulfur or other chemical species. Thus, the method of the invention may be applied to the gasification or reforming of any carbonaceous material or material mixture which is capable of being steam-gasified at temperatures of about 1200 to about 2800 degrees F. (about 649 to about 1538 degrees C.).

In its most reactive or "pure" form, ultra-superheated steam comprises a mixture of water vapor and carbon dioxide, together with an enhanced population of free radicals of the combustion products, and may be formed under such conditions that it is substantially devoid of free oxygen and free nitrogen. Moreover, the temperature of USS is defined as being significantly greater than steam produced in even the most advanced existing steam generating power plants, i.e. greater than about 2400° F. (1316° C.). As described herein, USS may be produced at temperatures ranging from about 2400° F. (1316° C.) to about 5000° F. (2760° C.).

In order to produce USS, a substantially ash-free carbonaceous fuel such as fuel oil, natural gas, etc. is burned by a homogeneous mixture of oxygen and water vapor at or very near to stoichiometric fuel:oxygen conditions. It has been found that the oxygen and water vapor must be homogeneously mixed prior to contact with the fuel. This mixture may be considered to comprise an "artificial air", and may have an oxygen concentration similar to that of atmospheric air. In practice, the oxygen content of the artificial air may vary from about 15 to about 60 volume percent. Preferably, the oxygen content of the artificial air may vary from about 15 to about 40 volume percent. More preferably, the oxygen content of the artificial air may vary from about 15 to about 30 percent. In practice, either the oxygen or water vapor, or the mixture thereof, may be preheated depending upon the heating value of the fuel and system parameters. Preferably, the hot steam (water vapor) is mixed with the unheated oxygen without subsequent heating of the mixture before introduction into a USS burner.

It has been discovered that when the stoichiometric combustion is conducted in a high-turbulence burner such as one having an aerodynamic or bluff body flame holder, at an adiabatic stable flame temperature of about 2400° F. (1316° C.) to about 5000° F. (2760° C.), a USS composition is produced as a distinctive clear, colorless flame indicative of a high concentration of free radicals within the flame envelope. These free radicals are known to generally enhance reaction rates and reaction completion in gasification.

The utilization of each of these aspects in combination results in a very rapid gasification of carbonaceous materials with low oxygen consumption, low steam consumption, and a high "cold efficiency". The term "cold efficiency" is used to define the fraction of the initial heat input which is recovered as heat of combustion in the product gas (syngas). The method of the invention may be configured to produce syngas having enhance hydrogen and carbon monoxide concentrations, as compared to conventional steam gasification methods.

Ultra-superheated steam composition may be used for gasification or reforming processes in any reactor design, including upflow, downflow, and lateral flow reactors. In one embodiment of the invention, the method is adapted for use in a fluidized bed reactor for gasification. A new burner is disclosed which efficiently creates an ultra-superheated steam flame from artificial air and fuel gas within the reactor.

BRIEF DESCRIPTION OF THE DRAWINGS

The invention is illustrated in the following figures, wherein.

DESCRIPTION OF THE PREFERRED EMBODIMENTS

Figure 1:
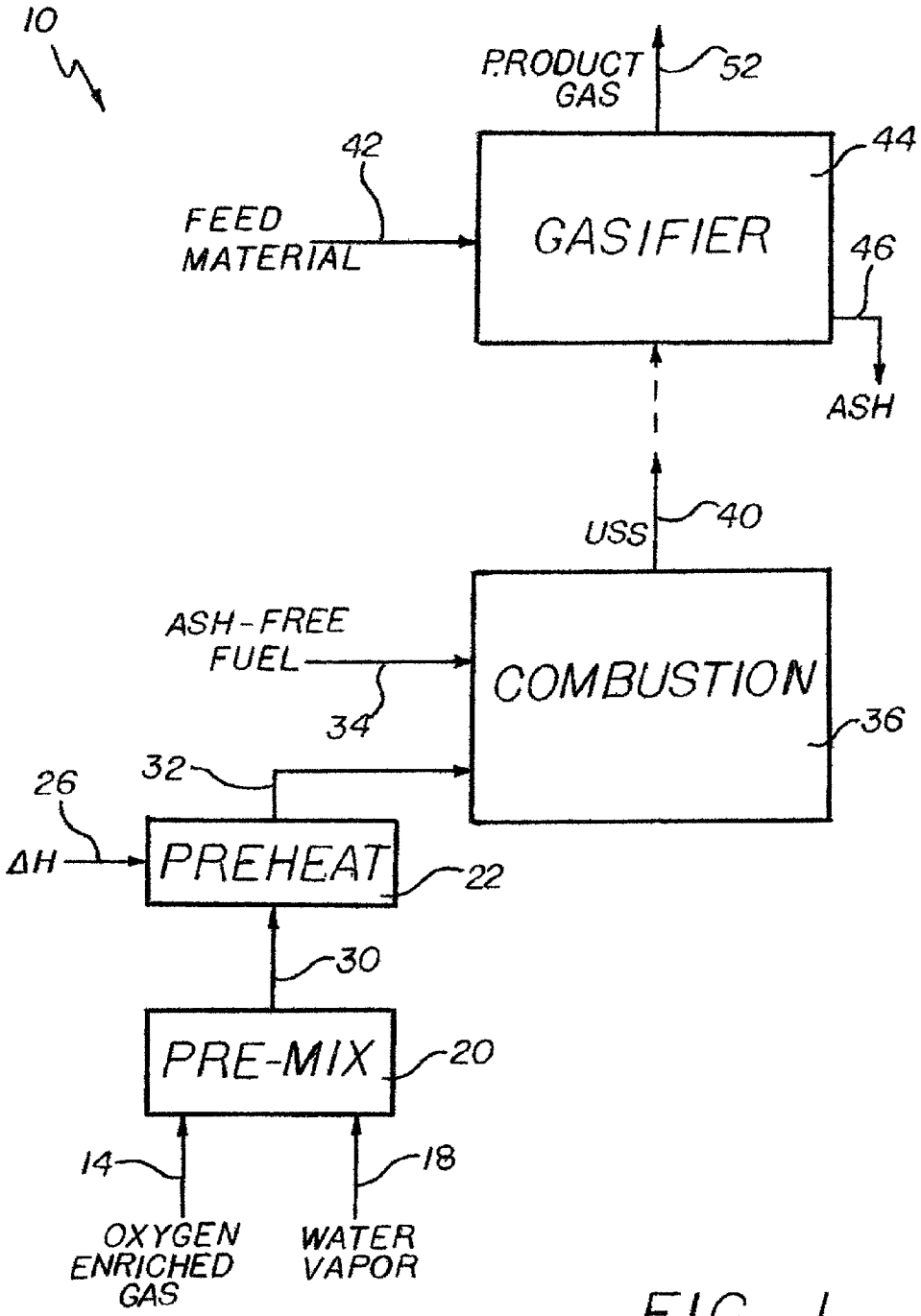
FIG. 1 is a generalized block diagram of a gasification process in accordance with the invention.

In this discussion, the term "ultra-superheated steam" or simply "USS" denotes a "synthetic" steam mixture whose composition is substantially water vapor ($H_2O$) and carbon dioxide ($CO_2$), together with a relatively high concentration of their free radical dissociation products. As defined herein, pure USS is substantially devoid of oxygen ($O_2$) and contains little or no nitrogen gas. It is difficult to produce USS which has absolutely no trace of free nitrogen or free oxygen, and such is not generally needed for most gasification applications. Thus, in the methods of the invention, the term USS refers to a specifically prepared steam composition which may contain up to about 5.0 mole percent free oxygen and/or up to about 5.0 mole percent free nitrogen. However, various aspects of the invention enable the ultra-superheated steam composition to provide substantially all of the necessary gasification heat. In that case, significant oxidation of the gasification feedstock is not required. Thus, the USS may be provided with a low oxygen content. Tor example, in one embodiment, the USS may be formed with about 3.0 percent oxygen or less. It is preferred that the ratio of free oxygen to fuel in the burner be such that the fuel is essentially completely burned. Inasmuch as it is difficult to achieve exact equivalence of oxygen and fuel, the burner may be operated with a slight excess of oxygen. The production of soot arising from inadequate oxygen level is detrimental to the process. Of course, any free oxygen remaining in the USS composition is available to the gasification feedstock, whose oxidation will yield additional heat to the process.

For the purposes of this invention, USS is produced at a minimum temperature of about 2400° F. (1,316° C., 1589° K), but may be formed at a temperature up to about 5000° F. (2760° C.).

In accordance with this invention, USS is produced by the following steps:

(1) An "artificial air" is formed by combining an enhanced oxygen gas and water vapor. The oxygen content of the enhanced oxygen gas is at least about 60 mole percent, and preferably at least about 80 mole percent. More preferably, the oxygen content is at least about 90 percent.

Following mixing of the enhanced oxygen gas with steam, the resulting artificial air may have an oxygen content of between about 15 mole percent and about 60 mole percent. Preferably, the oxygen content is less than about 50 mole percent, and more preferably, less than about 40 mole percent.

(2) A substantially ash-free fuel such as methane, natural gas, fuel oil, etc. is burned with the "artificial air". A portion of the produced syngas from the gasification process may be used as fuel to form the ultra-superheated steam composition.

(3) The oxygen provided by the "artificial air" is controlled to be substantially stoichiometric with respect to the ash-free fuel, so that, preferably, very little free oxygen remains upon combustion. Because of difficulties in maintaining the heating value of the fuel constant, and the oxygen concentration of the enhanced oxygen stream constant, the oxygen:fuel ratio will be set to provide a slight excess of oxygen to ensure that soot is not formed from substoichiometric operation. In other words, the oxygen:fuel ratio is maintained at a slight positive value.

(4) The oxygen and water vapor of the "artificial air" must be well mixed prior to contact with the fuel in a burner.

(5) The combustion of fuel with the artificial air takes place in a high turbulence burner with an aerodynamic or bluff body flame holder at an adiabatic flame temperature of about 2400° F. (1316° C.) to about 5000° F. (2760° C.).

Production of ultra-superheated steam at these high flame temperatures is characterized by a clear colorless "flame" in the burner flame holder, complete oxidation of the fuel, and a complete absence of soot. Clear colorless flames generated in this process are characteristic of the generation of large quantities of dissociation products, i.e. high energy free radicals. It is noted that when an oxygen-free USS is injected into a gasification reactor, no exothermic reactions will occur outside of the flame envelope.

Before proceeding further, it is necessary to define several terms used in this description. The term "substantially ash-free" refers to a fuel such as commercially available natural gas, propane, fuel oil, etc. Syngas from which solids and liquids have been removed is also substantially ash-free, and may be used to fuel the USS burner.

The term "carbonaceous" will be used herein to broadly define a fuel or gasifiable material which contains carbon in an elemental or chemically combined form. Thus, the term "carbonaceous" encompasses carbohydrates, coal and hydrocarbon materials, including organic polymers. Such materials may be mixed and/or chemically combined with, for example, halogens, sulfur, nitrogen or other chemical entities. Such materials may occur naturally or may be man-made, and may be solid, liquid or gas at ambient temperatures. Such materials may be commonly gasified on a large scale, and include coal, cellulosic materials (biomass), hydrocarbon fuels, chemical and refining wastes, and the like.

The term "flame temperature" is used herein to denote a calculated temperature of the combustion flame based on thermodynamic considerations, ignoring dissociation effects for computational simplicity. Actual accurate measurement of a flame temperature is very difficult. Thus, a theoretical adiabatic flame temperature is determined by calculation, ignoring any heat losses by radiation or other means to the atmosphere. Likewise, energy conversion in forming free radicals is ignored in the flame temperature calculations, since the effect is difficult to quantify.

The term "chemical heat" will be used to define the heat of combustion present in a fuel such as natural gas, coal or product gas (syngas), as determined at a base temperature such as 20° C. (77° F.), for example.

The term "gasification" will be used throughout the discussion and claims, and will be assumed to include processes known as "steam reforming", which for the purposes of the methods of this application are considered to be equivalent. The term "syngas" and "product gas" are used interchangeably and refer to the product from either a "gasification" process or "steam reforming" process. It is noted that the product gas from a steam reforming process may have a purpose other than use as a fuel, but the basic process itself is substantially equivalent.

Turning now to FIG. 1, the exemplary steps in a continuous gasification method 10 using USS 40 are depicted. As shown, an oxygen enriched gas 14 containing at least about 60 percent oxygen, and preferably at least about 80 percent oxygen, and more preferably about 90 percent oxygen, is mixed in pre-mix step 20 with water vapor 18 to form an "artificial air" 30. The oxygen may comprise anywhere from about 15 mole percent to about 40 mole percent of the artificial air 30. The pre-mixing of the oxygen enriched gas 14 and water vapor 18 is important to ensure a uniform blend thereof before introduction into the combustion step 36. In actual practice, the water vapor 18 may be provided as low pressure steam. The nitrogen component of air is largely or totally replaced by water vapor to avoid or reduce the addition of inert gases to the gasifier 44. The "artificial air" 30 may be preheated in step 22 by heat input 26, and is passed to a combustion step 36 as heated artificial air stream 32 to intimately contact and oxidize a substantially ash-free fuel 34. Some or all of the heat input 26 may be provided by heat exchange with the hot syngas 52 from the gasification process 44.

Figure 2:
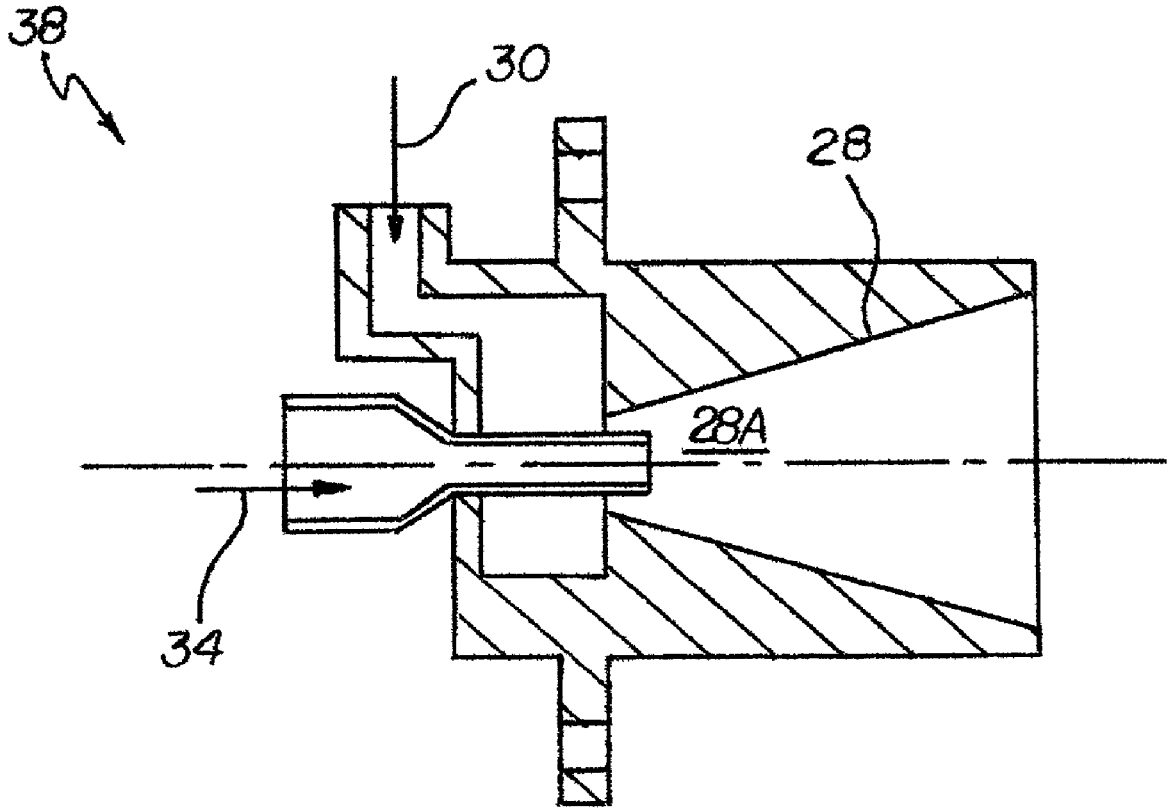
FIG. 2 is a general cross-sectional side view of a high turbulence burner which is representative of burners useful in the practice of the invention.

The formation of a high energy USS composition 40 in combustion step 36 appears to depend upon an efficient, stable, high turbulent combustion of the fuel 34 and artificial air 32. There may be many types of burner constructions which will meet these requirements and various flame shapes may be produced. Examples of such include burners are those in which the combustion takes place entirely within the flame stabilization zone 28A within an aerodynamic or bluff body flame holder 28 of the burner 38, a particular example of which is generally depicted in FIG. 2. Use of such burners 38 to provide USS composition 40 to a gasifier 44 avoids the requirement for expensive complex equipment for avoiding the contact of burner oxygen 14 with the gasifier feed material 42, and oxidation thereof.

Many of the burners 38 which may be used are commercially available for operation at temperatures up to about 5000° F. (2760° C.) and higher. Examples of such burners 38, without limitation thereto, are those designed for use with air pre-heated to a temperature of approximately 1,300° F. (704° C.) and those designed for use with oxygen-enriched air, i.e. >21% oxygen. Some available burners have a construction which inherently mixes the oxidizing gas prior to combustion.

Returning to FIG. 1, the combustion step 36 produces an ultra-superheated steam 40 at a controllable adiabatic flame temperature of about 2400° F. (1316° C.) to 5000° F. (2760° C.). As already noted, this USS composition 40 comprises primarily water vapor, carbon dioxide and dissociation products thereof, i.e. free radicals. The concentration of free oxygen in the USS composition 40 is no more than about 5.0 mole percent. In some applications, it will be advantageous to operate at very low oxygen concentrations in the USS composition 40, e.g. typically less than about 2.0-3.0 mole percent. This is the approximate minimum oxygen level at which complete combustion of the burner fuel may be assured. Nevertheless, beneficial use of the USS composition 40 may be obtained even when the method is controlled to provide a free oxygen concentration as high as about 5.0 percent. The USS composition 40 may contain a small quantity of nitrogen gas, the fraction depending upon the oxygen purity of the enriched gas 14.

While there may be numerous uses for ultra-superheated steam composition 40 in the chemical processing industries, the present application is primarily focused on its use in gasification or steam reforming of a carbonaceous feed material 42. Both processes utilize a steam composition to chemically alter a carbonaceous material.

As shown in FIG. 1, the ultra-superheated steam composition 40 may be directed to a gasification process 44, where it comprises the gasifying agent. Given a constant feed rate of carbonaceous feed material 42 to the gasifier 44, the gasification temperature, i.e. temperature of outlet syngas 52, is maintained by controlling both the temperature and quantity of USS composition 40. The gasifier temperature may be controlled despite normal variations in feed rate, feed temperature and feed material composition. The USS composition temperature is controlled by varying the ratio of water vapor 18 to either fuel 34 or oxygen enriched gas 14. The quantity of USS composition 40 per unit feed material 42 is varied to provide the required energy for maintaining the desired temperature.

As is well known, gasification of feed materials 42 such as coal, many common waste materials and the like results in formation of inert ash 46, which is discharged from the gasification process 44.

Several advantages of the use of USS composition 40 in thermal gasification process 44 result in part from the substantial exclusion of oxygen and nitrogen from the gasification reactor. The endothermic gasification reactions may be controlled to generate product gases 52 largely containing carbon monoxide and hydrogen, with very little inert gases. If the gasifier reaction takes place at high pressure, the equilibrium shifts toward the production of methane or other hydrocarbons. In either case, use of USS composition 40 with its high energy free radicals results in very rapid gasification and complete conversion of the carbonaceous feed material 42.

With an ultra-superheated steam composition 40, substantially all of the heat required to achieve the desired gasification temperatures may be provided by the change in sensible enthalpy of the USS, i.e. none of the gasification feed material 42 need be burned to provide heat energy. This may be achieved by operating the combustion process 36 at a high adiabatic flame temperature which is controlled to provide the necessary heat. An additional stream of high pressure steam into the gasifier is not required. A portion of the energy in the product gas 52 may be recovered in a superheater and waste heat boiler to heat the incoming artificial air 32.

Furthermore, because of the high (but unquantified) concentration of highly reactive free radicals in USS compositions 40, the endothermic gasification reactions are believed to be accelerated. Thus, a very rapid and efficient gasification process results from operation at stoichiometric or near-stoichiometric steam addition, without providing additional heat by other means.

For entrained flow gasifiers, the gasification feed material 42 is preferably fed to the gasifier 44 in reduced particle size. Furthermore, a feed material such as coal, for example, may be fed in atomized form to accelerate completion of the gasification reactions. However, the application of USS to gasification in a rotary kiln, for example, is advantageous because feed material comprising larger pieces may be accommodated.

Figure 3:
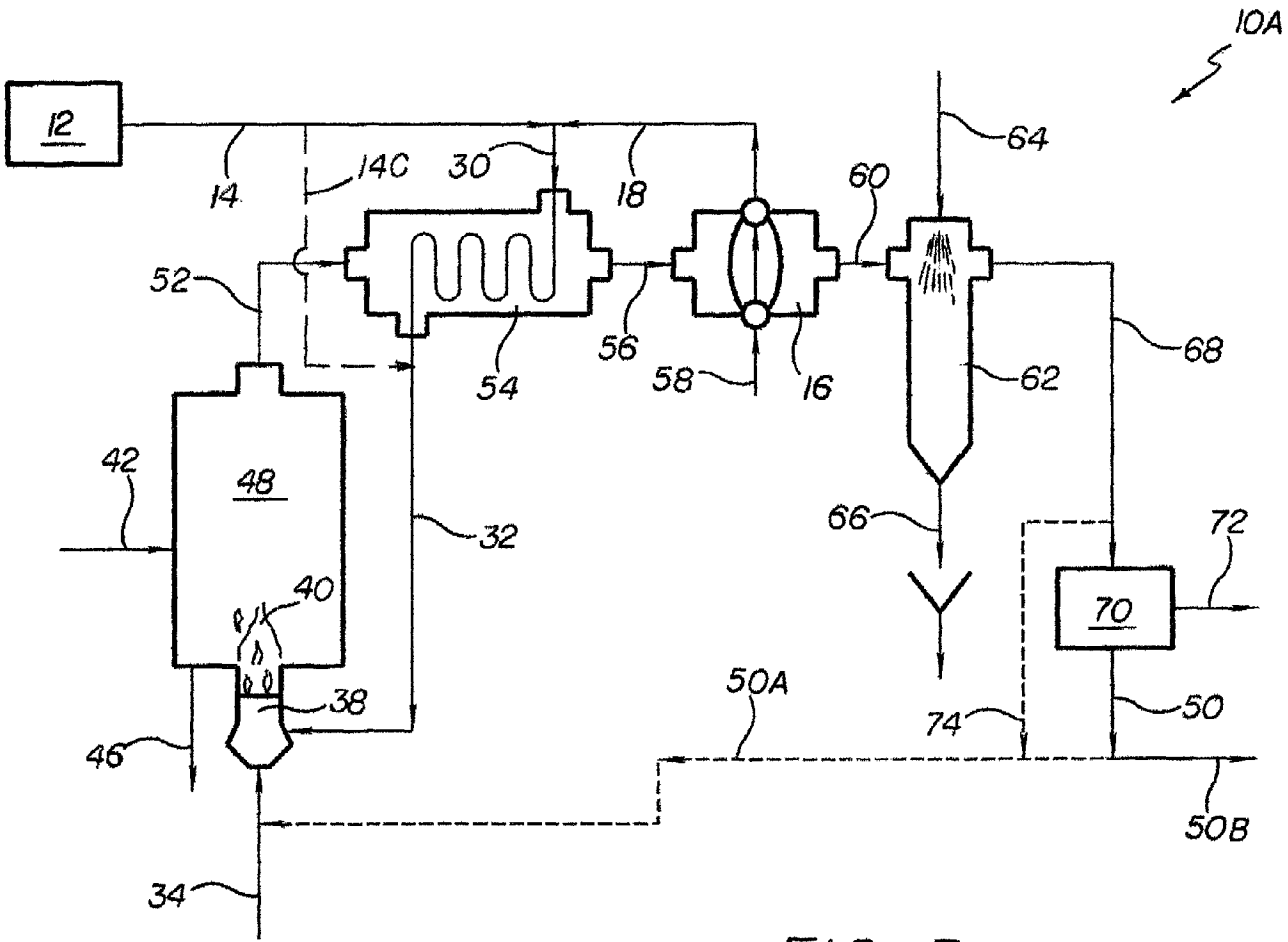
FIG. 3 is a generalized block diagram of an exemplary gasification process in accordance with an embodiment of the invention.

Turning now to FIG. 3, an exemplary gasification system 10A illustrates various aspects of the invention. Gasification reactor 48 is shown with a high turbulence burner 38 for producing the ultra-superheated steam composition 40. The burner 38 has a flame stabilization zone 28A in a flame holder 28, as previously described (see FIG. 2).

The burner 38 is fed a substantially ash-free fuel 34 such as methane, propane, natural gas, gasification syngas or a liquid fuel such as fuel oil. A homogeneous mixture of oxygen 14 from oxygen source 12 and water vapor 18 from waste heat boiler 16 is shown as being heated as artificial air stream 30 by passage through superheater 54. More preferably, the water vapor (steam) 18 from waste heat boiler 16 is further heated by passage through superheater 54, after which it is mixed with a stream 14C of oxygen to form the artificial air 32.

The heated artificial air 32 is injected into burner 38 where it is mixed with fuel 34 and burned under turbulent conditions, creating an ultra-superheated steam (USS) composition 40 having an adiabatic flame temperature of between about 2400° F. (1316° C.) and 5000° F. (2760° C.). In the gasification reactor 48, a carbonaceous feed material 42 is gasified by the USS composition 40 and attains a final temperature of about 1200° F. (649° C.) to about 2400° F. (1316° C.) before the syngas 52 leaves the reactor 48. The syngas 52 is cooled in superheater 54 and passes as cooled syngas 56 to waste heat boiler 16 for heating boiler feed water 58. The heated boiler feed water 58 is typically heated to become a saturated steam 18 which is homogeneously mixed with oxygen 14 to become "artificial air" 30. The steam 18 may be further heated to e.g. about 1200 degrees F. (649 degrees C.) either before or following its mixture with oxygen 14 or 14C.

In this example, the further cooled product gas 60 is then scrubbed by a water stream 64 in scrubber 62. The scrubbed cooled product gas 68 is then dried in dryer 70. Wastewater streams 66 and 72 are shown in the figure. The dry product gas 50 is then available for export from the system 10A. Optionally, a portion 50A of the dry product gas 50 may comprise a portion or all of the fuel 34 introduced into the burner 38. Alternatively, a portion or all of the recycled portion 50A may comprise wet product gas 74. which thus supplies a portion of the required water vapor to the burner 38.

Using USS composition 40 of a higher temperature, the quantity of USS used may be decreased while yet supplying the required heat to drive the gasification reactions.

Figure 4:
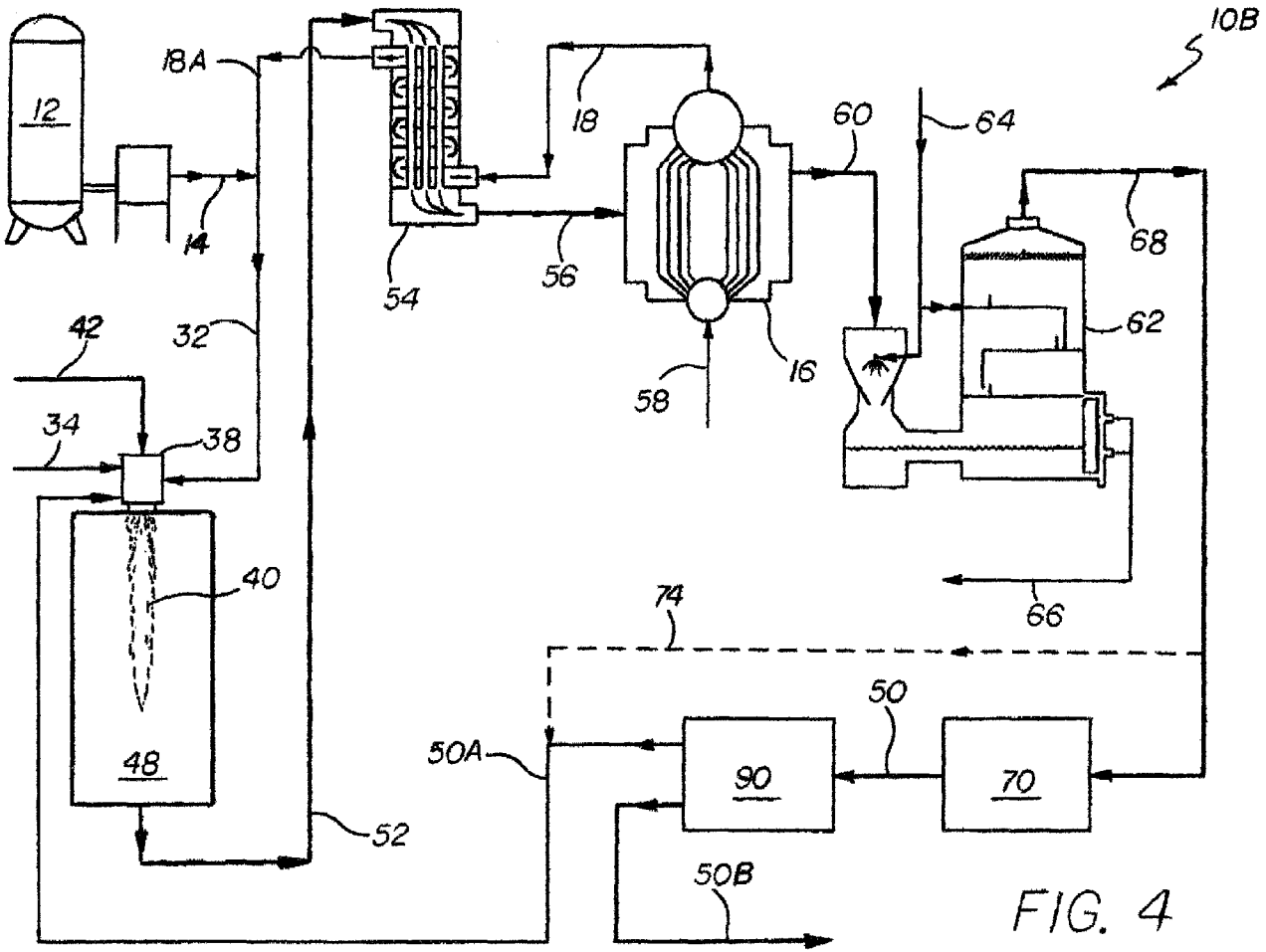
FIG. 4 is a generalized block diagram of another exemplary gasification process in accordance with another embodiment of the invention.

Turning now to FIG. 4, another embodiment of the gasification process is depicted. The process 10B of FIG. 4 is similar to process 10A of FIG. 3, with several alternative steps and apparatus therefor. Gasification reactor 48 is depicted as a downflow reacator for the sake of illustration, but may comprise any mechanical configuration useful for gasification. For example, the reactor 48 may be upflow, downflow, a packed bed, a rotating kiln type, or other design. Of course, the gasification apparatus may comprise a reactor 48 filled with e.g. coal and operated batchwise.

Like the process shown in FIG. 3, a flame of ultra-superheated steam 40 is produced in a burner 38 by combustion of an ash-free fuel with "artificial air" 32. The artificial air 32 is a mixture of steam 18 from waste heat boiler 16 and oxygen or enriched air 14 from an oxygen supply 12. The ratio of oxygen in the artificial air 32 to the burner fuel 34 is preferably maintained at a level slightly greater than stoichiometric, in order to ensure complete oxidation of the burner fuel and a high concentration of free radicals in the USS 40. The USS 40 is injected into a stream of feed material 42 to be gasified within reactor 48.

The produced gas (syngas) 52 is shown being cooled in a steam superheater 54 and steam boiler 16 whereby the stream of steam 18 is heated. The cooled syngas 60 is cleaned by e.g. water 64 in a scrubber 62, producing a stream of cooled clean syngas 68 containing e.g. CO, $CO_2$, $H_2$, $CH_4$, some $H_2O$. An aqueous waste stream 66 is typically directed to a treatment system, As shown in FIG. 4, the syngas 68 may be subjected to a final drying and polishing step 70, producing a clean dry syngas 50. The syngas 50 is then passed to a fractionation step 90 in which the syngas is separated into:

A. A first stream largely containing the carbon monoxide, carbon dioxide and methane fractions; and B. A second stream largely containing the hydrogen gas fraction.

The fractionation step 90 may be achieved by any technique which separates hydrogen gas from the carbon containing fractions. Exemplary methods include but are not limited to membranes, pressure swing adsorption, molecular sieves, and the like.

In a preferred embodiment, at least a portion of the first fractionation stream containing CO and $CO_2$ is recycled as steam 50A to the burner 38 where it comprises all or a portion of the burner fuel. It is noted that a separate fuel 34 may be initially used to start up the burner (and the gasification process) until stream 50A is produced. Where additional water is required for gasification at steady state, a portion of syngas 68 may be routed ss stream 74 to join stream 50A.

Material and energy balances for an example of this method are shown in Example C, infra, together with a discussion of the advantages which are achieved.

In an alternative method, a portion or all of the recycle stream 50A comprises the hydrogen fraction. Of course, the hydrogen will be simply converted to steam (water) in the burner As is well known, a gasification process may be controlled to maximize the CO and $H_2$ of the syngas.

Also, as is well known, the production of byproducts $CH_4$ and higher order hydrocarbons increases exponentially with increasing pressure and decreasing reactor temperature.

Figure 7:
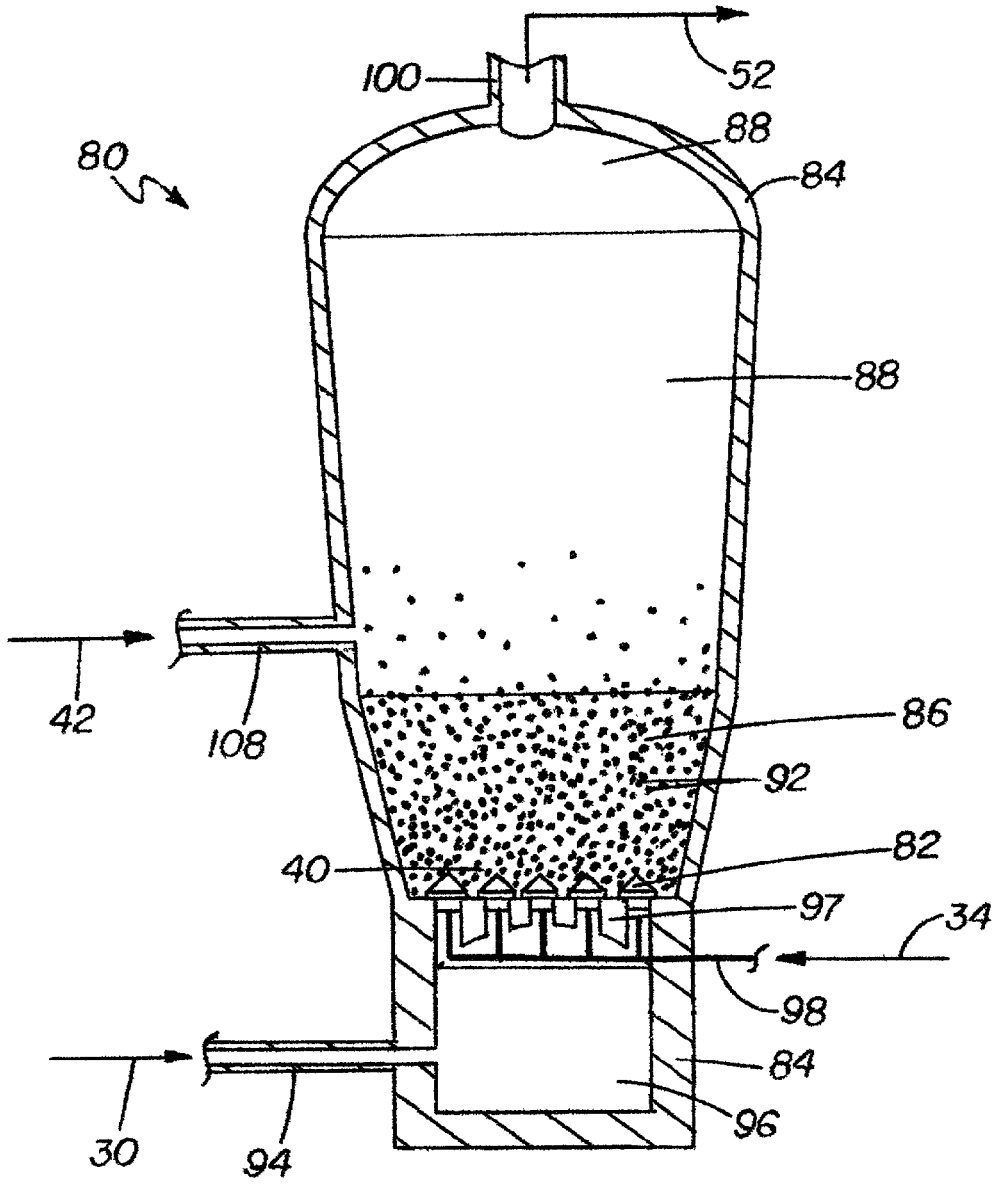
FIG. 7 is a simplified cross-sectional view of a fluidized bed gasification reactor to which the use of an ultra-superheated steam composition is applied in accordance with the invention.

As shown in FIGS. 7, 7A, 7B, 8, 9, and 10, gasification/reforming may be advantageously conducted in a fluidized bed reactor 80 equipped with a USS burner 82 configured in accordance with the invention. A typical fluidized bed reactor 80 is shown in FIG. 7 with a wall 84 enclosing a lower bed section 86 containing particulate fluidizable materials 92, and an upper solids separation section 88. In accordance with the invention, the floor of the reactor 80 comprises a truyere or burner mount 97 with passages therethrough into which a plurality of burners 82 are attached. The reactor is configured for passage of an artificial air 30 (comprising a mixture of steam and oxygen-enriched gas, as previously defined) through pipe 94 into a slightly pressured underchamber 96 and thence through the burners 82. A substantially ash-free fuel 34 as previously defined is passed through pipes 98 into each burner 82 at a controllable rate. A USS composition 40 is produced at the burner outlets; the USS composition results in gasification of a carbonaceous material 42 introduced into the reactor through inlet 108. Syngas 52 produced in the reactor 80 is discharged through upper exit pipe 100.

Figure 10:
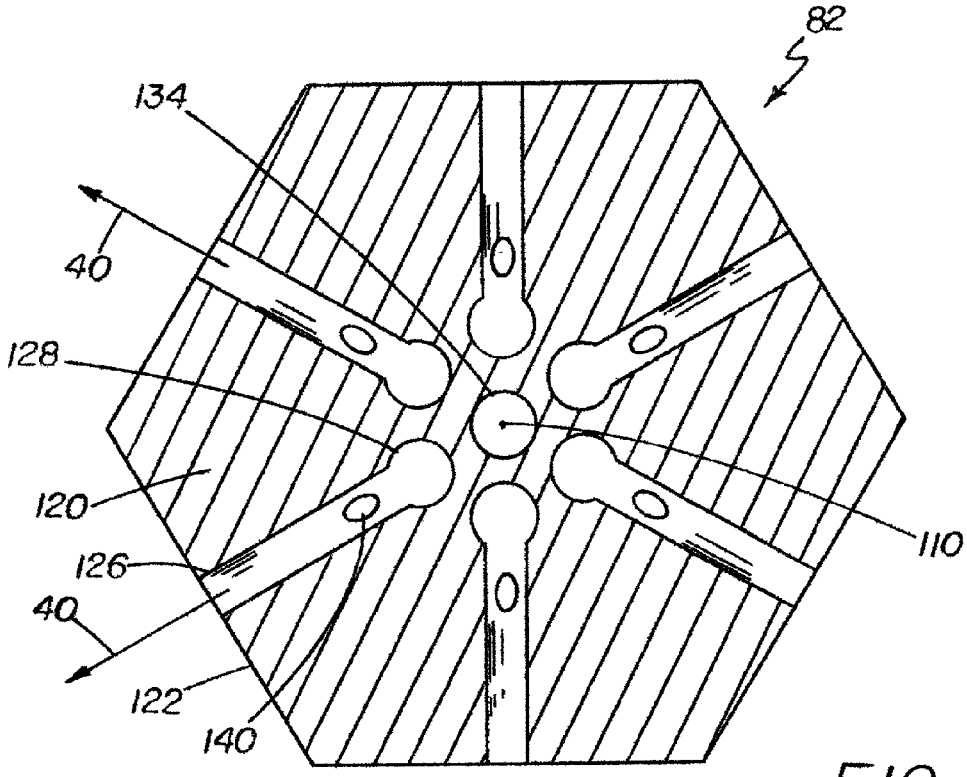
FIG. 10 is a cross-sectional bottom view of a burner of the invention for producing an ultra-superheated steam composition, as taken along line 10-10 of FIG. 9.
Figure 7A:
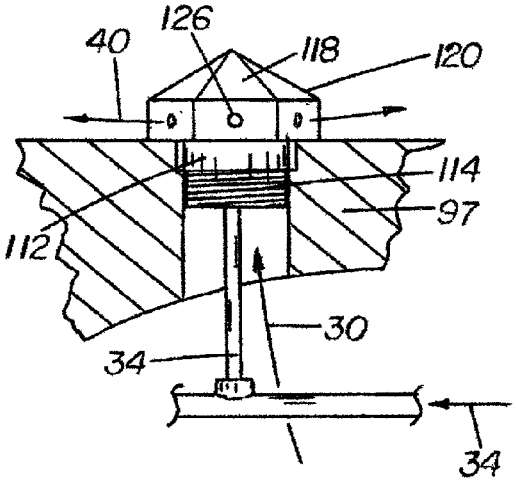
FIG. 7A is an enlarged portion of FIG. 7 including a burner of the invention mounted in a tuyere of a fluidized bed gasification reactor for producing an ultra-superheated steam composition.
Figure 7B:
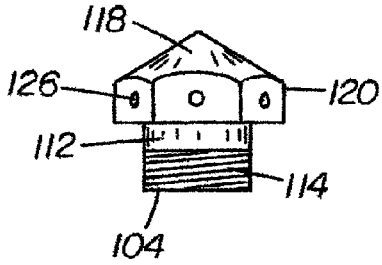
FIG. 7B is a side view of another embodiment of a burner of the invention for producing an ultra-superheated steam composition.
Figure 9:
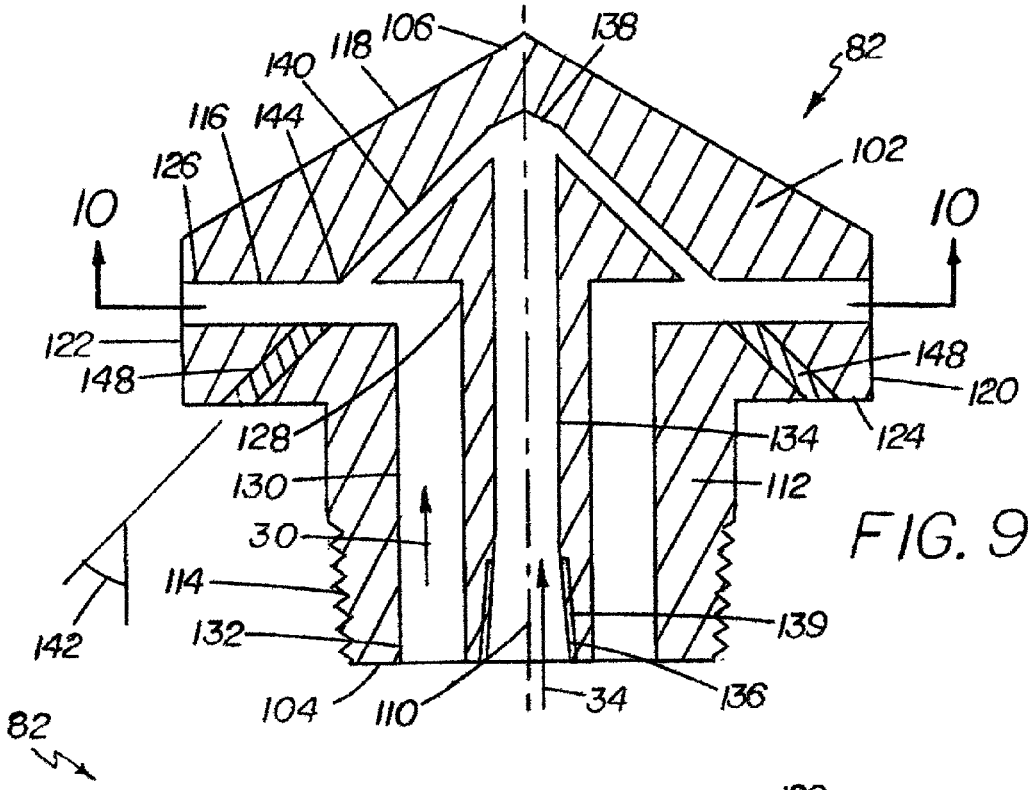
FIG. 9 is a cross-sectional side view of a burner of the invention for producing a ultra-superheated steam composition for gasification in accordance with the invention, as taken along line 9-9 of FIG. 8.
Figure 8:
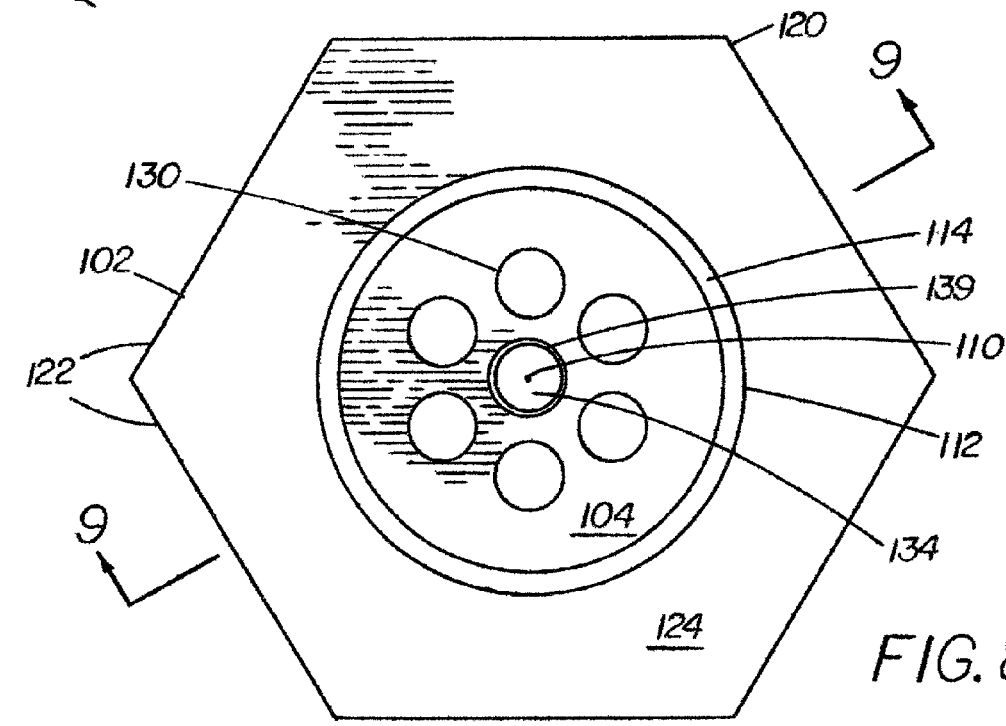
FIG. 8 is a bottom view of a burner of the invention for gasification with an ultra-superheated steam composition in accordance with the invention.

As depicted in FIGS. 8, 9 and 10, an example of the burner 82 of the invention is shown with a body 102 having a lower end 104 and an upper end 106. A central axis 110 passes through ends 104, 106. A lower portion 112 is shown with a round cross-section with external screw threads 114 for attachment of the burner 82 to the tuyere or burner mount 97 of a steam gasification/reforming reactor 80. An upper burner portion 120 is shown with a top surface 118, hexagonally arranged sides 122 about axis 110 (for rotating the burner 82 for installation/removal, and a lower shoulder surface 124. The top surface 118 may be generally conical (see FIG. 7B) or pyramidal (see FIG. 7A) in shape, to avoid buildup of fluidization particles 92 thereon. A plurality of burner outlet passages 116 extend inwardly from outlet openings 126 on the sides 122 to an inner terminus 128. The outlet passages 116 are radially spaced about central axis 110 and generally perpendicular to axis 110. Optionally, the outlet openings 126 may be higher than the inner termini 128 to direct the produced USS flame 40 upwardly. A plurality of gas inlet passages 130 extend from inlets 132 on the lower end 104 to meet the inner termini 128, for flow of artificial air 30 from inlets 132 to outlet openings 126. The inlet passages 130 are shown arranged about a central axial inlet passage 134 which passes upward from an inlet 136 in the lower end 104 to a central terminal position 108 above the burner outlet passages 116. The inlet 136 is shown with internal screw threads 139 for attachment to a fuel gas supply line 98 (see FIG. 7). From the central terminal position 108, radially spaced secondary passages 140 extend angularly downward and outward to intersect each of the burner outlet passages 116 at intersections 144 proximate the outlet openings 126. The angle 142 between the secondary passages 140 and the central axis 110 is configured to provide fuel gas 34 just upstream of the outlet openings 126. Thus, the angle 142 will normally be in the range of about 40 to 65 degrees, depending on the burner dimensions. The number of burner outlet openings 126 will typically be in the range of about 4 to about 12, and is shown as 6 in the figures. Thus, fuel gas 34 may be supplied at controllable flow rate to each of the burners 82, and become intimately mixed with hot artificial air 30 just prior to being ejected into the reactor from outlet openings 126 as an ultra-superheated steam flame 40. Upward movement of hot USS composition 40 from the burners 82 expands and fluidizes the solid particles of the bed of particles 92 for efficient gasification of a feedstock carbonaceous material 42.

The burner 82 of the invention may be readily formed from a high temperature resistant metal or alloy by forming a burner body 102 having an upper end 106, a lower end 104. An upper portion 120 of the burner 82 has an top surface 118 which may be formed to be conical or pyramidal. The sides 122 of the upper portion 120 may be formed to be part of a wrench-turnable shape such as a hexagon or octagon. The central axial inlet passage or hole 134, burner outlet passages 116 and gas inlet passages or holes 130 are formed by drilling. Secondary passages or holes 140 are drilled from the shoulder portion 124 to meet the central terminal position 138 of passage 134 and to intersect the burner outlet passages 116 between the inner termini 128 of passages 130 and the outlet openings 126. The extraneous portion 146 of each secondary passage or hole 140 is then filled with a high temperature resistant material 148, e.g. by welding shut with the same metal which comprises the burner 82. As already indicated, the angle 142 of the secondary passages 130 may vary depending upon the burner dimensions, and is typically between about 40-65 degrees with the central axis 110. In the example illustrated in the drawings, the lower portion 112 may include an external screw thread 114, and the central axial inlet passage may have an internal screw thread 139. Alternative methods of attachment may include, for example, welding, clamps, and the like. It is important that leakage of fuel gas 34 be avoided, to ensure that oxidation is confined to the burner outlet passages 116 downstream of the intersections 144, as well as in the lower bed section 86 outside of the burner 82. This embodiment of burner 82 provides a uniform generation of horizontally directed high velocity USS flames 80 across the reactor bottom, preventing stagnation in the reactor 80, and results in a very high degree of intimate contact between materials to be gasified/reformed and the USS flame.

Several examples which illustrate the invention follow:

EXAMPLE A

Experiments in producing USS were conducted using a commercially available burner produced by North American Manufacturing Company of Cleveland, Ohio. The burner, identified as a model #4425-3, with a nominal rating of 350,000 BTU/Hr, has an aerodynamic flame holder for producing a stable flame under high turbulence conditions. The burner was mounted on a test stand in the Enercon Systems factory in Elyria, Ohio, and directed to fire through a hole through the factory wall to the outside. A sheet metal tube was placed about one foot away from the burner flame to shield the flame from direct sunlight for personal observation. Additional cooling air was allowed to enter the duct coaxially to avoid overheating the duct.

The oxidizing gas fed to the burner was either (1) air, or (2) a "synthetic air" comprising a mixture of oxygen (21% w/w) and steam (79% w/w), and the fuel comprised natural gas having a heating value of about 1,000 BTU per cubic foot (7140 Kcal per cubic meter). The oxidizing gas pressure was approximately 1 psig. The water vapor i.e. steam was generated by a very small boiler with manual control of the natural gas flow rate to produce water vapor at about 215° F. (102° C.). The boiler was operated at less than 10 psig pressure. The burner ignition pilot of the boiler was operated with a conventional air/natural gas mixture to avoid unnecessary experimental problems. The quantity of nitrogen introduced by the pilot air was calculated to be less than about 0.1 percent of the high temperature ultra-superheated steam (USS) 52 which was produced. The flow rates of oxygen, steam and natural gas flows were measured by orifice plates.

The operating conditions and results were as follows:

Ambient Air Test

Air composition: 79 w/w % nitrogen, 21 w/w % oxygen

Firing Rate: approximately 300,000 BTU/Hr.

When observed during operation with ambient air as the oxidizing gas, the burner produced a blue flame with yellow and red tinges on the flame tips; this observation is normal for combustion with air. The calculated adiabatic flame temperature under these conditions was 3550° F. (1954° C.).

Artificial Air Test

Artificial Air Composition:

21 w/w % oxygen 79 w/w % water vapor

Firing Rate: Approximately 300,000 BTU/Hr.

During operation with the "synthetic air", the flame was observed to be clear and colorless, i.e. invisible. However, the sheet metal ducting was very hot i.e. glowing red, and the invisible "flame" was radiating a great deal of heat. The calculated adiabatic flame temperature under these conditions was 3270° F. (1799° C.). As is well known, a clear, colorless flame is indicative of the presence of large numbers of free radicals which enhance reaction rates.

Contrary to expectations, the "synthetic air" established and maintained a stable flame with no problems whatsoever.

EXAMPLE B

Figure 5:
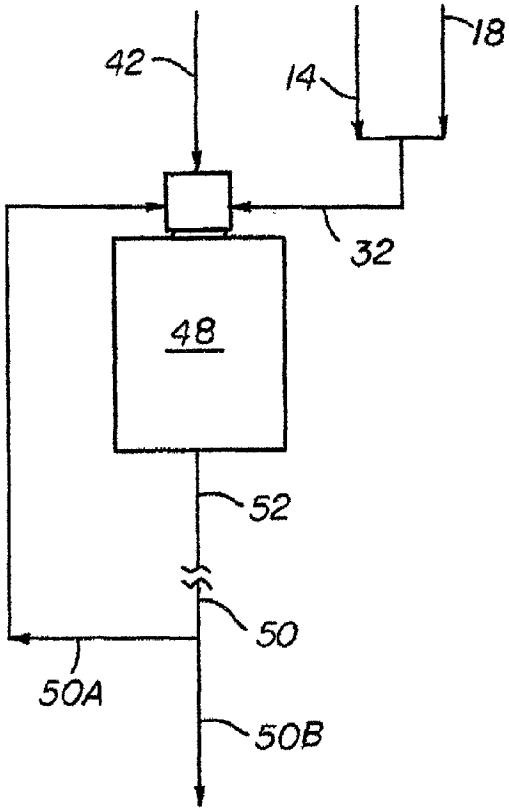
FIG. 5 is a simplified block diagram of one embodiment of the gasification process of FIG. 3 in accordance with the invention.

Heat balances and material balances about a thermal gasification system of FIG. 5 were calculated using a computer program for simultaneously solving for steady state equilibrium conditions with mass and energy balances.

The carbonaceous feed material 42 in this example is assumed to be pure α-celllulose fed to gasification reactor 48 at a rate of 1.00 tons per hour. The cellulose is assumed to have a general chemical formula $C_6H_{10}O_5$.

The burner 38 is operated totally on recycled dry syngas 50A as the fuel (no imported burner fuel 34). The burner fuel comprises a mixture of hydrogen, carbon dioxide, carbon monoxide and methane after cooling and water removal.

Temperature of synthetic air 32: 1200° F.

Temperature of oxygen 14 in synthetic air 32: 1200° F.

Reactor 48 operating temperature: 1800° F.

Burner 38 adiabatic flame temperature: 4500° F.

Percent oxygen 14 in synthetic air 32: 32.4%

Percent steam 30 in synthetic air 32: 67.65

Heating value of dry syngas 50B, BTU/STD.CF: 264

Reactor 48 Operating Pressure: 0.0 PSIG

The steady-state material input to the system is as follows, in pounds:

| Component | | Carbon | Hydrogen | Oxygen | Total |
|---|---|---|---|---|---|
| Steam 18 | | 0.00 | 90.97 | 721.99 | 812.96 |
| Oxygen 14 | | 0.00 | 0.00 | 691.99 | 691.99 |
| Syngas 50 | $CH_4$ | 30.60 | 10.27 | 0.00 | 40.87 |
| | $CO_2$ | 174.17 | 0.00 | 464.08 | 638.25 |
| | CO | 162.05 | 0.00 | 215.89 | 377.94 |
| | $H_2$ | 0.00 | 39.44 | 0.00 | 39.44 |
| Biomass 42 | | 888.80 | 124.40 | 986.80 | 2000.00 |
| Total | | 1255.62 | 265.09 | 3080.75 | 4601.46 |

The steady-state net material output from the system 10A is as follows, in pounds:

| Component | Carbon | Hydrogen | Oxygen | Total |
|---|---|---|---|---|
| $CH_4$ | 104.74 | 35.16 | 0.00 | 139.90 |
| $CO_2$ | 596.16 | 0.00 | 1588.52 | 2184.72 |
| CO | 554.69 | 0.00 | 738.97 | 1293.66 |
| $H_2O$ | 0.00 | 94.91 | 735.25 | 848.16 |
| $H_2$ | 0.00 | 135.01 | 0.00 | 135.01 |
| Total | 1255.62 | 265.09 | 3080.75 | 4601.46 |

The heat input to the reactor 48 is as follows, in BTU:

| Component | | Chemical Heat | Heat of Vaporization | Sensible Heat | Total Heat |
|---|---|---|---|---|---|
| Steam | | 0 | 852,309 | 444,695 | 1,297,005 |
| Oxygen | | 0 | 0 | 185,581 | 185,581 |
| Syngas (dry) | $CH_4$ | 875,822 | 0 | 0 | 875,822 |
| | $CO_2$ | 0 | 0 | 0 | 0 |
| | CO | 1,642,884 | 0 | 0 | 1,642,884 |
| | $H_2$ | 2,410,003 | 0 | 0 | 2,410,003 |
| Biomass | | 15,000,000 | 0 | 0 | 15,000,000 |
| Total | | 20,028,709 | 852,309 | 630,276 | 21,511,295 |

The heat output from the reactor is as follows, in BTU:

| Component | | Chemical Heat | Heat of Vapor-zation | Sensible Heat | Total Heat |
|---|---|---|---|---|---|
| Syngas | $CH_4$ | 3,340,208 | 0 | 222,715 | 3,562,923 |
| | $CO_2$ | 0 | 0 | 1,017,404 | 1,017,404 |
| | CO | 5,623,538 | 0 | 602,332 | 6,225,870 |
| | $H_2O$ | 0 | 889,212 | 749,818 | 1,639,030 |
| | $H_2$ | 8,249,362 | 0 | 816,707 | 9,066,069 |
| | Total | 17,213,108 | 889,212 | 3,408,975 | 21,511,295 |

The net syngas dry output is as follows:

| Component | Pounds | BTU |
|---|---|---|
| $CH_4$ | 99.03 | 2,364,386 |
| $CO_2$ | 1546.46 | 0 |
| CO | 915.72 | 3,980,654 |
| $H_2$ | 95.57 | 5,839,359 |
| Total | 2656.78 | 12,184,399 |

EXAMPLE C

Figure 6:
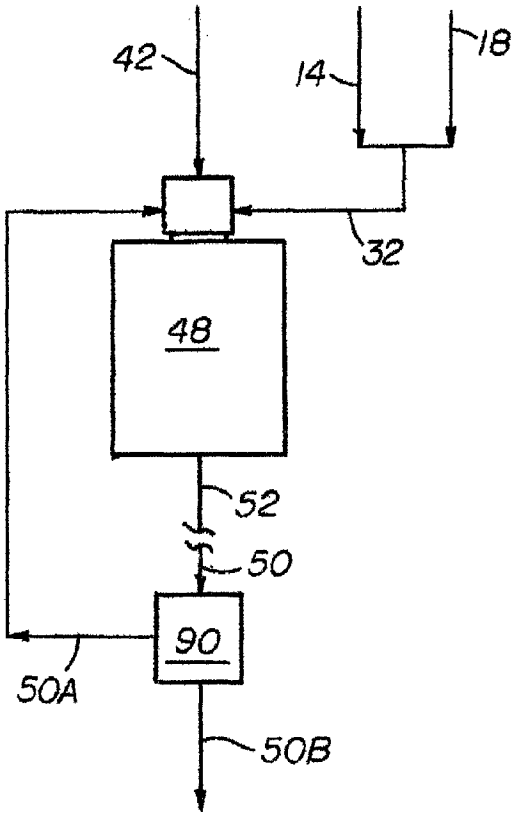
FIG. 6 is a simplified block diagram of another embodiment of the gasification process of FIG. 4 in accordance with the invention.

Heat balances and material balances about a thermal gasification system of FIG. 6 were calculated using a computer program for simultaneously solving for steady state equilibrium conditions with mass and energy balances. In this example, the dried syngas 50 is fractionated into a CO-containing stream 50A and a hydrogen-containing stream 50B. The stream 50A is recycled in this example as burner fuel 50A to burner 38. The assumed operating conditions are as follows:

As in Example B, the carbonaceous feed material 42 is pure alpha-cellulose fed to the reactor 48 at a rate of 1.00 tons per hour. The cellulose is assumed to have a general chemical formula $C_6H_{10}O_5$.

The burner 38 is operated totally on recycled dry syngas 50A (no imported burner fuel 34 once the burner has started).

The raw cooled syngas 68 is fractionated into a first fraction 50A containing substantially all of the carbon monoxide, and a second fraction 50B containing substantially all of the hydrogen gas. In this example, the first fraction 50A is recycled to comprise the fuel 50A for burner 38.

Temperature of Synthetic Air 32: 1200° F.

Temperature of Oxygen 14 in Synthetic (artificial) Air 32: 1200° F.

Reactor 48 Operating Temperature: 1800° F.

Burner 38 Adiabatic Flame Temperature: 4500° F.

Percent Oxygen 14 in Synthetic Air 32: 22.4%

Percent Steam 30 in Synthetic Air 32: 77.6

Heating Value of Dry Syngas, BTU/STD. CF: 258

Gasifier Reactor 48 Operating Pressure, PSIG: 0.00

The steady-state material input to the system is as follows, in pounds:

| Component | | Carbon | Hydrogen | Oxygen | Total |
|---|---|---|---|---|---|
| Steam 18 | | 0.00 | 130.59 | 1036.42 | 1167.01 |
| Oxygen 14 | | 0.00 | 0.00 | 599.20 | 599.20 |
| Syngas 50 | $CH_4$ | 0.00 | 0.00 | 0.00 | 0.00 |
| | $CO_2$ | 0.00 | 0.00 | 0.00 | 0.00 |
| | CO | 449.77 | 0.00 | 599.20 | 1048.97 |
| | $H_2$ | 0.00 | 0.00 | 0.00 | 0.00 |
| Biomass 42 | | 888.80 | 124.40 | 986.80 | 2000.00 |
| TOTAL | | 1338.57 | 254.99 | 3221.61 | 4815.17 |

The steady-state net material output from the system 10A is as follows, in pounds:

| Component | Carbon | Hydrogen | Oxygen | Total |
|---|---|---|---|---|
| $CH_4$ | 97.87 | 32.86 | 0.00 | 130.73 |
| $CO_2$ | 637.09 | 0.00 | 1697.50 | 2334.59 |
| CO | 603.61 | 0.00 | 804.14 | 1407.75 |
| $H_2O$ | 0.00 | 90.72 | 719.97 | 810.69 |
| $H_2$ | 0.00 | 131.42 | 0.00 | 131.42 |
| TOTAL | 1338.57 | 254.99 | 3221.61 | 4815.17 |

The heat input to the reactor 48 is as follows, in BTU:

| Component | | Chemical Heat | Heat of Vaporization | Sensible Heat | Total Heat |
|---|---|---|---|---|---|
| Steam | | 0 | 1,223,493 | 638,362 | 1,861,855 |
| Oxygen | | 0 | 0 | 160,695 | 160,695 |
| Syngas(dry) | $CH_4$ | 0 | 0 | 0 | 0 |
| | $CO_2$ | 0 | 0 | 0 | 0 |
| | CO | 4,559,856 | 0 | 0 | 4,559,856 |
| | $H_2$ | 0 | 0 | 0 | 0 |
| Biomass | | 15,000,000 | 0 | 0 | 15,000,000 |
| Total | | 19,559,856 | 1,223,493 | 799,057 | 21,582,406 |

The heat output from the reactor is as follows, in BTU:

| Component | | Chemical Heat | Heat of Vaporization | Sensible Heat | Total Heat |
|---|---|---|---|---|---|
| Syngas | $CH_4$ | 3,121,100 | 0 | 208,105 | 3,329,205 |
| | $CO_2$ | 0 | 0 | 1,087,197 | 1,087,197 |
| | CO | 6,119,501 | 0 | 655,454 | 6,774,955 |
| | $H_2O$ | 0 | 849,927 | 716,691 | 1,566,618 |
| | $H_2$ | 8,028,493 | 0 | 794,939 | 8,824,432 |
| Total | | 17,270,093 | 849,927 | 3,462,387 | 21,582,406 |

The net syngas dry output is as follows:

| Component | Pounds | BTU |
|---|---|---|
| $CH_4$ | 130.73 | 3,121,100 |
| $CO_2$ | 2334.59 | 0 |
| CO | 358.79 | 1,559,644 |
| $H_2$ | 131.42 | 8,029,493 |
| Total | 2955.52 | 12,710,236 |

Comparing the results of Example B and Example C, it is evident that by using a carbon monoxide rich stream 50A as the burner fuel, certain advantages accrue.

First, a stream 50B rich in hydrogen gas $H_2$ is produced. Hydrogen is an important material for example in the manufacture and technology of fuel cells, pollution-free fuels, and in the chemical industries.

Secondly, the stream 50A containing the carbon monoxide is an excellent ash-free fuel for producing ultra-superheated steam in the burner 38.

Third, the quantities of hydrogen gas and methane produced in the gasifier are increased by about 30+ percent.

The several examples of producing and using ultra-superheated steam which are shown and described herein are considered to be exemplary only, and the descriptions of operating conditions and apparatus utilized thereon are not to be interpreted as limiting the invention.

Thus, it is apparent to those skilled in the art that various changes and modifications may be made in the methods and apparatus of the invention as disclosed herein without departing from the spirit and scope of the invention as defined in the following claims.

What is claimed is:

1. A method for producing an ultra-superheated steam composition, comprising the steps of:

providing a source of oxygen-enriched gas;

providing a source of water vapor;

pre-mixing said oxygen-enriched gas and water vapor from said sources to form a substantially homogeneous mixture; and contacting said substantially homogeneous mixture with a substantially ash-free fuel in a high turbulence burner with one of an aerodynamic and bluff body flame holder to promote the formation of free radical species of burner combustion products at an adiabatic flame temperature of at least about 2400° F. (1316° C.);

whereby an ultra-superheated steam composition is produced in said burner comprising a mixture of superheated water vapor, carbon dioxide and free radicals;

wherein said ultra-superheated steam composition has a temperature of at least about 2400° F. (1316° C.).

2. A method in accordance with claim 1, wherein the ratio of oxygen in said oxygen-enriched gas to said ash-free fuel is controlled to produce ultra-superheated steam composition containing less than about 5 mole percent oxygen.

3. A method in accordance with claim 1, wherein the ratio of oxygen in said oxygen-enriched gas to said ash-free fuel is controlled to produce ultra-superheated steam composition containing less than about 3 percent free oxygen.

4. A method in accordance with claim 2, wherein said oxygen-enriched gas comprises at least about 60 mole percent oxygen.

5. A method in accordance with claim 2, wherein said oxygen-enriched gas comprises at least about 80 mole percent oxygen.

6. A method in accordance with claim 2, wherein said oxygen-enriched gas comprises at least about 90 mole percent oxygen.

7. A method in accordance with claim 1, wherein said homogeneous mixture of water vapor and oxygen-enriched gas is formed to comprise about 15 to about 60 mole percent oxygen.

8. A method in accordance with claim 1, wherein said homogeneous mixture contacts said substantially ash-free fuel comprising one of a petroleum-based liquid, hydrocarbon containing gas, and a produced fuel gas from a gasification process.

9. A method in accordance with claim 1, wherein said quantity of oxygen in said substantially homogeneous mixture is controlled to be substantially stoichiometric with respect to the quantity of substantially ash-free fuel.

10. A method in accordance with claim 1, wherein at least one of said water vapor, said oxygen, and said mixture thereof is pre-heated prior to contacting with said substantially ash-free fuel.

11. A method in accordance with claim 1, wherein said homogeneous mixture is contacted with said oxygen-enriched gas to produce said ultra-superheated steam (USS) at an adiabatic flame temperature of between about 2400° F. (1316° C.) and about 5000° F. (2760° C.).

12. A method in accordance with claim 1, wherein said ultra-superheated steam is produced in a clear colorless flame.

13. A method in accordance with claim 1, wherein the ratio of oxygen to fuel, and said flame temperature are controlled to produce said ultrasuperheated steam composition containing less than about 5 mole percent free nitrogen gas.

14. A method in accordance with claim 1, further comprising the step of collecting and directing said ultra-superheated steam to an industrial process.

15. A method in accordance with claim 14, wherein said ultrasuperheated steam is directed to a gasification process in which a carbonaceous material is converted to a syngas containing CO and $H_2$.

16. A method in accordance with claim 15, wherein a portion of said syngas is recycled to said burner as at least a portion of said ash-free burner fuel.

17. A method in accordance with claim 14, wherein said industrial process comprises a steam reforming process in which a carbonaceous material is converted to a syngas containing reformed carbonaceous material.

* * * * *